US006543209B1

(12) United States Patent
Siegel et al.

(10) Patent No.: US 6,543,209 B1
(45) Date of Patent: Apr. 8, 2003

(54) ROBOTIC COMPATIBLE BLISTER PACKAGE

(75) Inventors: Todd Siegel, Clearwater, FL (US); Stuart Bagley, Clearwater, FL (US); Michael Stevenson, Clearwater, FL (US)

(73) Assignee: Medical Technology Systems, Inc., Clearwater, FL (US)

( * ) Notice: Subject to any disclaimer, the term of this patent is extended or adjusted under 35 U.S.C. 154(b) by 0 days.

(21) Appl. No.: 09/537,594

(22) Filed: Mar. 28, 2000

(51) Int. Cl.[7] ..... B65D 75/58
(52) U.S. Cl. ..... 53/492; 206/469; 206/532
(58) Field of Search ..... 206/461–465, 206/467–471, 531, 532, 534, 539, 705; 53/492

(56) References Cited

U.S. PATENT DOCUMENTS 2,892,541 A * 6/1959 Hahn ..... 206/470
3,467,248 A * 9/1969 Makowicki ..... 206/462
3,685,648 A * 8/1972 Heller ..... 206/461
3,948,391 A * 4/1976 Beaman ..... 206/461
4,200,193 A * 4/1980 Boyle ..... 206/461
5,497,882 A * 3/1996 Kenyon ..... 206/461
5,819,939 A * 10/1998 Boyer ..... 206/461
5,878,885 A * 3/1999 Wangu et al. ..... 206/461
5,927,496 A * 7/1999 Seaton et al. ..... 206/461
6,016,914 A * 1/2000 Gustafson ..... 206/470
6,029,818 A * 2/2000 Kumakura et al. ..... 206/469

* cited by examiner

*Primary Examiner*—Jim Foster
(74) *Attorney, Agent, or Firm*—Robert J. Depke; Holland & Knight LLC

(57) ABSTRACT

A pharmaceutical product package employs a clear plastic member that includes at least one cavity within which one or more pharmaceutical products may be located. The cavity is preferably centrally located within the boundaries of the overall package in a lower portion thereof. The clear plastic member preferably includes one or more additional elongated structural protrusions that extend outward in the same direction as the cavity for housing the pharmaceutical products. These elongated structural protrusions are formed lengthwise parallel to and near the edges of the package. The pharmaceutical package of the present invention also desirably includes a central void or opening in the clear plastic material which is preferably located above the cavity for the solid pharmaceutical. The void provides location for receiving a hook or other protruding member for hanging the product package on the hook or other protruding member. The backing material includes a corresponding void or opening that at least substantially matches the opening in the clear plastic material. A tab of backing material extends into the region of the void in the clear plastic material.

14 Claims, 3 Drawing Sheets

ROBOTIC COMPATIBLE BLISTER PACKAGE

BACKGROUND OF THE INVENTION

1. Field of the Invention

The present invention relates generally to the field of solid pharmaceutical packaging products and methods. More specifically, the present invention is directed to an improved pharmaceutical product package that can be easily opened by a user and which can also be readily manipulated by automated robotic packaging systems.

2. Description of the Related Art

There are currently a wide variety of pharmaceutical packaging products that are generally available in a variety of configurations. The majority of these existing solid pharmaceutical packaging products employ a clear plastic cover member that typically has a plurality of bubbles or cavities within which one or more solid pharmaceutical products may be located. Usually, a plurality of cavities are formed in a single sheet of clear plastic material and a piece of backing material is secured to a rear side of the clear plastic cover to seal a solid pharmaceutical product located within each cavity.

During the packaging process, one or more solid pharmaceutical products are inserted into the respective cavity locations formed in the clear plastic member. This clear plastic member is then attached to some type of backing material which is usually comprised of either foil or some type of paper or cardboard backing. The backing material is secured to the cover member with an adhesive. The package is then ready for use by consumers. Individuals are required to remove the backing material in order to gain access to the pharmaceutical located within the cavity when using the pharmaceutical products.

While existing pharmaceutical product packaging solutions are convenient for most people and provide ready identification of the pharmaceutical located within the clear plastic cavity, many people still have difficulty when opening these existing pharmaceutical packaging products. This is especially true when the user has an illness such as arthritis which makes opening the package particularly difficult. Accordingly, there remains a need in the art for a pharmaceutical product package that can be readily manufactured but yet which provides the user with easy access to medication located within the package.

Another shortcoming of existing pharmaceutical product packaging solutions is that the existing packages are not particularly suitable for manipulation by automated robotic packaging systems. These automated robotic packaging systems use a variety of different package assembly manipulation systems and a variety techniques for manipulating product packaging materials during the packaging process.

In order to be compatible with these machines, there are several characteristics for the packaging materials that are desirable in order to provide a package that is more suitable for manipulation by automated robotic systems. One particularly desirable feature is that the package should maintain a given orientation so that automated machinery can grasp the package more reliably. Currently, there are no existing packaging solutions that are both well-suited for interaction with automated robotic systems and which also provide a package that can be readily manipulated and opened by a person accessing the pharmaceuticals within the package.

For example, existing packaging solutions cannot be easily manipulated by these systems due to the fact that the packages are not well balanced and they are typically not designed for interaction with the packaging machines. Accordingly, there remains a need in the art for a pharmaceutical product package that can be easily manipulated by automated robotic packaging systems. There also remains a need in the art for a pharmaceutical product package that can be readily opened by a person seeking to use the pharmaceutical products stored within the product package. Other objects and advantages of the present invention will be apparent from the following Summary and Detailed Description of the Preferred Embodiments.

SUMMARY OF THE INVENTION

In accordance with the present invention, a pharmaceutical product package employs a clear plastic member that includes at least one cavity within which one or more pharmaceutical products may be located. This cavity is preferably centrally located within the boundaries of the overall package in a lower portion thereof. This lower central location is desirable for interaction with automated robotic packaging systems and for providing easy access to the solid pharmaceuticals stored within the cavity. However, it should be recognized that it is not necessary that the cavity be formed in this location.

The clear plastic member preferably includes one or more additional elongated structural protrusions that extend outward in the same direction as the cavity for housing the pharmaceutical products. These elongated structural protrusions are formed lengthwise parallel to and near the edges of the package. The elongated structural protrusions are preferably located on the external perimeter of the product package. They are desirably formed only at each side and the top of the product package. The elongated structural protrusions increase the strength of the package while also providing balance for the package during the manufacturing process.

The pharmaceutical package of the present invention also desirably includes a central void or opening in the clear plastic material which is preferably located above the cavity for the solid pharmaceutical. The void provides location for receiving a hook or other protruding member for hanging the product package on the hook or other protruding member. The backing material includes a corresponding void or opening that at least substantially matches the opening in the clear plastic material. A tab of backing material extends into the region of the void in the clear plastic material. A person desiring to open the package can readily grasp the protruding tab of backing material that extends into a corresponding void in the backing material formed over the region of the void or opening in the clear plastic material. A person using the product package is thereby able to readily open the pharmaceutical package by simply inserting a finger into the hole and pulling the tab down and away from the clear plastic member.

The backing material also preferably includes scoring or perforations in the backing material that desirably extend downward and angle out from the tab. The scoring or perforations preferably extend to the portion of the backing material that is located over or adjacent to the cavity. When a person opens the product package, the tab is pulled downward thereby tearing the scoring or perforations in the backing material. The scoring or perforations allow the package to be opened more easily.

Another inventive feature of the present invention is that the clear plastic member also further includes at least one support protrusion that preferably extends to substantially a same height as the height of the cavity. Preferably two of these structural supports are formed at or near the upper corners of the product package. The structural supports in conjunction with the cavity may be used to provide balanced support for an adjacent product package. Specifically, the back of an adjacent product package will maintain substantially the same orientation as the supporting package due to the fact that the structural supports are substantially the same height as the cavity.

It will be recognized that although it is preferred that two of these structural supports be formed in the upper opposite comers, it is contemplated that a single structural support protrusion may be formed to accomplish similar results. The structural supports, regardless of their location may be formed as further extensions of the elongated structural protrusions. Specifically, the extension of the clear plastic material for the elongated structural protrusions may have portions that extend further in certain regions for formation of the structural supports. This may be seen in the exemplary embodiments described below. Alternatively, they may be independently formed.

DETAILED DESCRIPTION OF THE PREFERRED EMBODIMENTS

Figure 1:
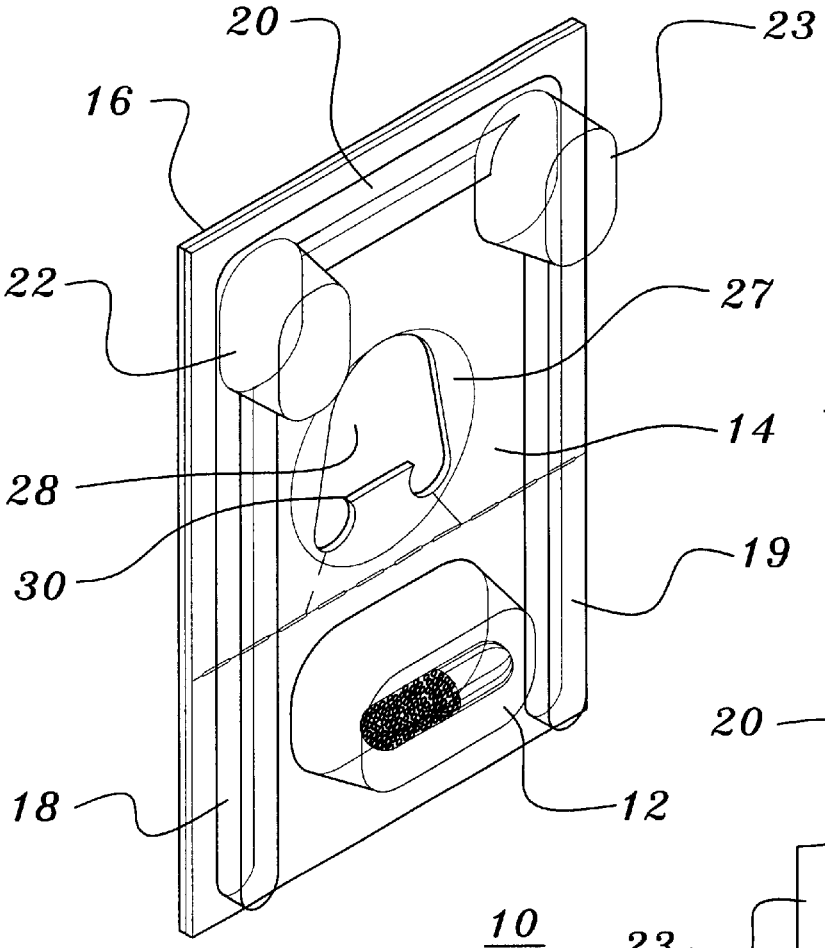
FIG. 1 illustrates a frontal view of a first exemplary embodiment of the present invention.

As shown in FIG. 1 generally at 10, the improved product package of the present invention includes numerous inventive characteristics. The product package includes a preferably centrally located cavity 12 in a lower portion of a preferably contiguous clear plastic member 14. This clear plastic member 14 is mounted on a piece of backing material 16 which is desirably co-extensive with the outer perimeter of the clear plastic member 14. It is preferred that the cavity 12 be located in a substantially centered lower portion of the clear plastic member 14 in order to provide balance for the product package when it is mounted on a holding device. Additional inventive features of the exemplary embodiment include first and second elongated structural protrusions 18, 19 formed within the clear plastic member.

As shown in the exemplary embodiment illustrated in FIG. 1, the elongated structural protrusions 18, 19 are desirably formed substantially along an entire length of the side of the package. These elongated structural protrusions serve several purposes. First, due to the symmetric nature of these protrusions they aid in balancing the pharmaceutical product package during the manufacturing process. Furthermore, these elongated structural protrusions or ribs provide rigidity for the package and aid in providing integrity for the overall package. It will be recognized by those skilled in the art that the elongated structural members 18, 19 need not be formed along the entire side of the clear plastic member 14. However, it is preferred that the extend substantially along the entire length in order to provide more integrity for the package. Additionally, it will be recognized that the single members 18, 19 may be formed into a plurality of separate ridge structures in order to provide similar results, however, it will be appreciated that in order to provide more simplified manufacturing process for the clear plastic member, it is desirable that each of the side members be unitary structures for ease of manufacturing. A further elongated structural member 20 is may be formed along the top edge of the package as in the preferred embodiment to further increase the structural integrity of the package. It will also be recognized that these members are not necessary if the backing material and clear plastic cover material are sufficiently rigid.

Figure 2:
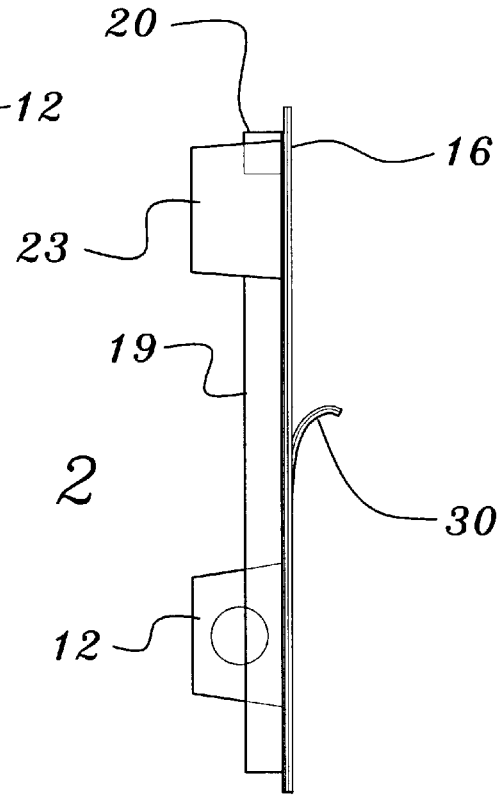
FIG. 2 illustrates a side view of the embodiment of FIG. 1.

As shown in FIG. 1, the improved pharmaceutical product package of the present invention further includes balancing structural protrusions 22, 23 which are preferably formed on opposite upper comers of the clear plastic member 14. These balancing structural protrusions 22, 23 are preferably formed to substantially a same elevation as the cavity 12. It is preferred that these members be formed to this elevation in order to ensure that adjacent packages maintain similar orientation for improved automated manipulation. This feature is best shown in FIG. 2 where the preferred relative elevations of the respective structures can be readily perceived. Those skilled in the art will recognize that the elevations need not be identical, however, it is preferred that they be of at least substantially the same height of the cavity 12 in order to most effectively ensure that the product package remains in a substantially vertical orientation for automated manipulation. Those skilled in the art will recognize that the elongated structural supports could be formed to the same height as the cavity for the same purpose, however, it is preferred that only the structural protrusions extend as shown for ease of manufacture. The one or more structural protrusions may be easily formed as an extended portion of the elongated structural members. A single structural support protrusion could also be formed rather than multiple support protrusions as shown.

FIG. 1 also illustrates a preferably circular orifice formed in the clear plastic member 14. This orifice 27 serves several purposes. The orifice 27 is preferably at least co-located with a corresponding orifice 28 in the backing material 16. The co-located orifices desirably allow hanging of the product on a hook or other protrusion during the manufacturing process. Furthermore, the co-location of the orifice allows a user who is opening the package to readily access a tab 30 formed in the backing material 16. Those skilled in the art will recognize that the opening in the clear plastic cover material is not necessary in order to provide access to the tab member 30.

FIG. 2 illustrates a side view of the product package shown in FIG. 1. As shown in FIG. 2, the protruding tab member 30 which desirably extends over the orifice 27 in the clear plastic packaging material is shown peeled back during opening of the pharmaceutical package illustrated in FIG. 1. FIG. 2 most clearly illustrates the preferred relative elevations of the respective structures illustrated in FIG. 1. A person opening the product package illustrated in FIGS. 1 and 2 simply inserts a finger into the void formed into the backing and clear plastic material while facing the back of the product package. The person can easily pull the tab down and away from the remaining backing material.

Figure 3:
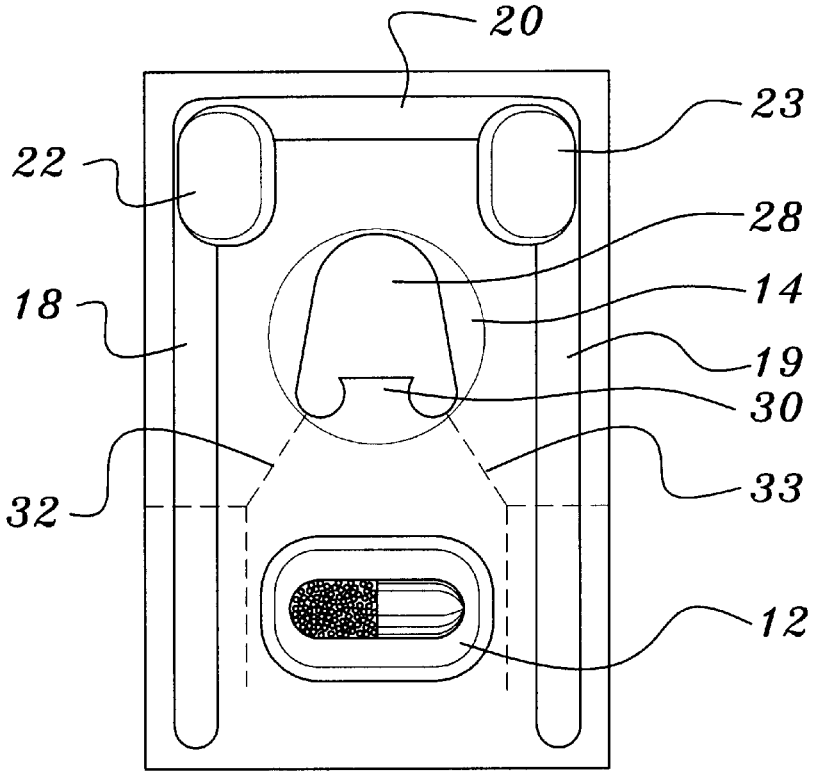
FIG. 3 is an alternate frontal view of the exemplary embodiment of the present invention illustrated in FIG. 1.

FIG. 3 illustrates a top plan view of the product package shown in FIG. 1. As shown in FIG. 3, the product package of the present invention also desirably includes scoring or perforations 32, 33 in the backing material 16. FIG. 3 illustrates two alternate embodiments for the scoring or perforations in the backing material. The scoring or perforations 32, 33 are designated by the dashed lines extending outward and downward from the tab member 30. The scoring or perforations preferably extend in the backing material downward from the tab member 30. Alternatively, the scoring or perforations may extend downward and then horizontally outward across the entire package so that the bottom portion of the backing may be pulled from the top clear plastic member. As noted, the scoring or perforations may simply extend downward from the tab 30 adjacent the sides of the cavity 12 formed in the clear plastic member 14. The scoring or perforations are preferably angled outward away from the tab member in order to create a larger opening when the tab member is pulled backward and down from the orifice to expose the cavity and the clear plastic member 12. It will be appreciated that other orientations for the scoring or perforations are possible as well.

Adhesive may be selectively applied to the backing material in order to maintain a sealed cavity while also facilitating the ease of opening the cavity with the tab member 30. For example, the adhesive may be formed around the cavity and selectively only in portions that are outside of the scoring or perforations in order to provide an easier opening package. For example, the adhesive may be exclusively around the perimeter of the package and around the cavity member 30. In the top portion of the package, the adhesive may only be selectively applied in regions where there will be contact between the clear plastic cover member and the backing material in order to eliminate waste. Those skilled in the art will appreciate that other alternate configurations for the adhesive are possible as well.

Figure 4:
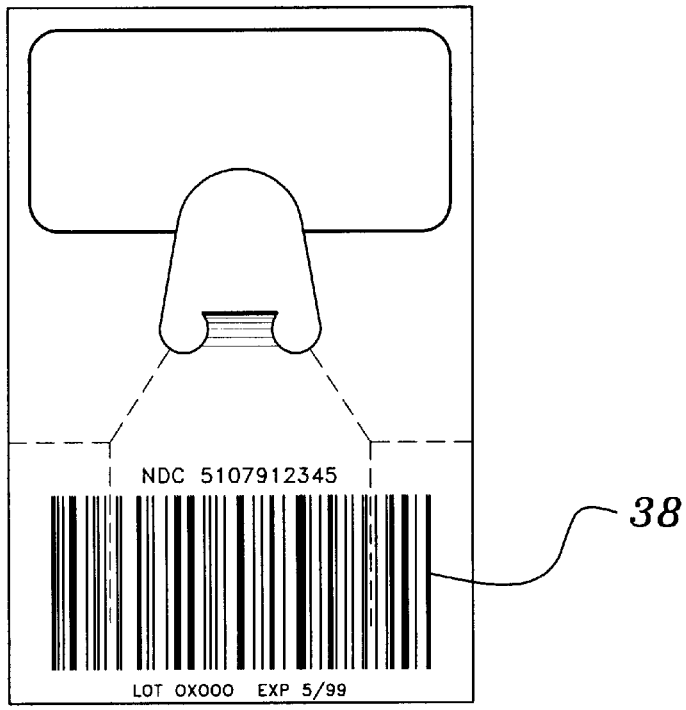
FIG. 4 illustrates a rear view of the exemplary inventive product package shown in FIG. 1.

FIG. 4 illustrates a rear-side plan view of the product package illustrated in FIG. 1. FIG. 4 also illustrates the scoring or perforations in the backing material described above with reference to FIG. 3. However, in FIG. 4, the scoring or perforations are shown only downward from the tab 30 and then horizontally across the entire backing member. Those skilled in the art will appreciate that the particular orientation of the scoring or perforations in the backing is preferred only and other orientations are possible as well. The purpose of the scoring or perforations is simply to provide a person using the package with easier access to the pharmaceuticals.

Figure 5:
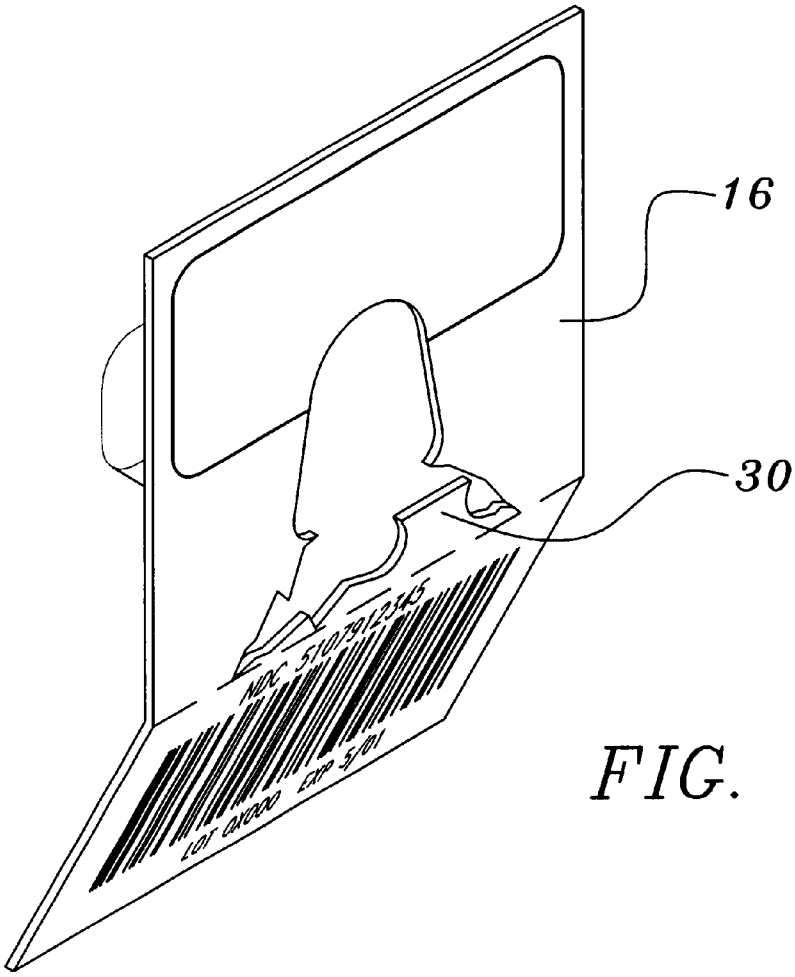
FIG. 5 illustrates a rear view of the product package during opening.

FIG. 4 also illustrates a preferably bar coded product package designator 38 . This product package bar code may desirably include information regarding the actual drug stored within the product package as well as expiration codes, lot codes or any other information which is desired. FIG. 5 illustrates further opening of the product package described above with reference to FIGS. 1–4. As shown in FIG. 5, a proportion of the package member may be bent forward to further improve access to the tab member during the opening process. This facilitates easy opening of the product package by individuals having arthritis or other medical problems which would typically make it difficult to open existing product packages. It will be recognized by those skilled in the art that bending forward of the product package is not necessary as easy access to the tab member and scoring of the product package should independently create easy access to the pharmaceutical contained within the product package cavity 12.

Figure 6:
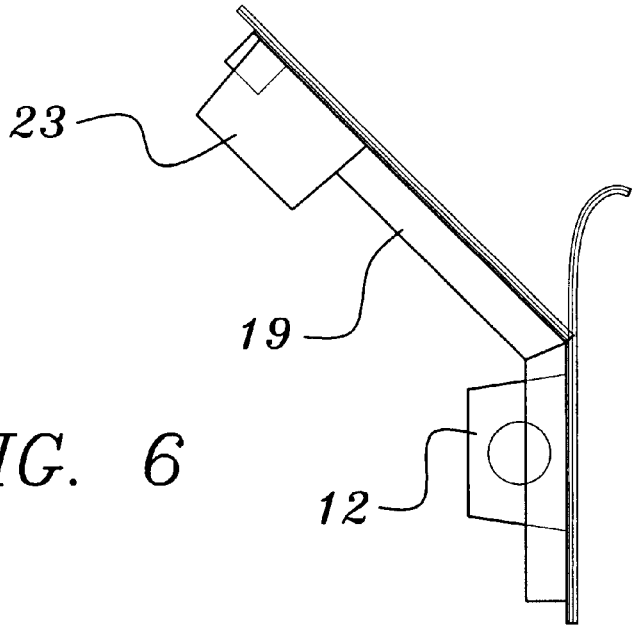
FIG. 6 illustrates a side view of the product package during opening.

FIG. 6 is a side view illustration of the pharmaceutical product package shown in a partially opened position wherein the top portion of the package is pulled away from the tab member 30. As noted, this is the preferred orientation of the package during opening. However, it is also possible to open the product package simply by pulling away a portion of the backing material with assistance of the scoring in the backing material.

Those skilled in the art will recognize that the embodiments described above are exemplary only and that variations in the shape or structures described herein can be readily made by those skilled in the art while nevertheless falling within the spirit and scope of the appended claims.

We claim:

1. A pharmaceutical product package comprising:

a plastic cover member and backing member;

said cover member having at least one pharmaceutical product cavity formed therein and an opening in the cover member; and said backing member having a tab member extending into a region void of backing material adjacent the plastic cover member in a region at least partially overlapping the opening in the cover member and further wherein the tab member extends away from a region of the cavity and wherein the opening in the cover member is of sufficient size to enable an individual to insert a finger in the opening for the purpose of engaging the tab member.

2. The pharmaceutical product package of claim 1, further comprising at least one elongated structural member formed in the plastic cover material along an edge of the package.

3. The pharmaceutical product package of claim 2, further comprising at least two elongated structural member formed in the plastic cover material along two edges of the package.

4. The pharmaceutical product package of claim 1, further comprising at least one balancing structural protrusion formed in the plastic cover material, said balancing structural protrusion having substantially a same height as the cavity.

5. The pharmaceutical product package of claim 1, wherein the product cavity is completely enclosed by the backing member.

6. The pharmaceutical product package of claim 1, further comprising at least one weakened region in the backing material extending from the tab member.

7. The pharmaceutical product package of claim 1, wherein the opening in the cover member is a region that is completely surrounded by the material of the cover member and defines a hole.

8. The pharmaceutical product package of claim 1, wherein the backing material has at least two weakened regions extending from the tab member and the weakened regions extend to opposed the edges of the backing material.

9. The pharmaceutical product package of claim 7, wherein the product cavity is completely enclosed by the backing member.

10. The pharmaceutical product package of claim 9, wherein the backing material has at least two weakened regions extending from the tab member and the weakened regions extend to opposed the edges of the backing material.

11. The pharmaceutical product package of claim 5, wherein the backing material has at least two weakened regions extending from the tab member and the weakened regions extend to opposed the edges of the backing material.

12. The pharmaceutical product package of claim 7, wherein the region void of backing material is at least partially coextensive with the hole.

13. The pharmaceutical product package of claim 12, wherein the tab member extends into a region of the hole and the hole is sufficiently sized to enable a person to readily engage the tab with a finger by inserting a finger into the hole.

14. A method of opening a pharmaceutical product package comprising the steps of:

bending a portion of a cover member in a direction away from a backing member in order to provide access to a tab portion of the backing member which was located adjacent the portion of the cover member that was bent away from the backing member prior to bending the portion of the cover member; and pulling the tab portion of the backing member away from the cover member to expose a cavity.

* * * * *